US009114622B2

(12) United States Patent
Smith

(10) Patent No.: US 9,114,622 B2
(45) Date of Patent: Aug. 25, 2015

(54) SEAL AND SEAL/BOSS ASSEMBLY

(75) Inventor: Mark A. Smith, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 688 days.

(21) Appl. No.: 12/951,001

(22) Filed: Nov. 20, 2010

(65) Prior Publication Data

US 2011/0062673 A1 Mar. 17, 2011

Related U.S. Application Data

(63) Continuation of application No. PCT/US2008/064236, filed on May 20, 2008.

(51) Int. Cl.
*B41J 2/175* (2006.01)

(52) U.S. Cl.
CPC ..... *B41J 2/1752* (2013.01); *B41J 2/17523* (2013.01); *B41J 2/17553* (2013.01)

(58) Field of Classification Search
USPC ..... 277/606, 607, 612, 630, 642, 644
See application file for complete search history.

(56) References Cited

U.S. PATENT DOCUMENTS

| | | | | |
|---|---|---|---|---|
| 2,892,987 | A * | 6/1959 | Cedrone | 333/254 |
| 3,334,774 | A * | 8/1967 | Poltorak | 220/378 |
| 4,311,315 | A * | 1/1982 | Kronenberg | 277/397 |
| 4,471,965 | A * | 9/1984 | Jennings et al. | 277/322 |
| 5,029,879 | A * | 7/1991 | Strang et al. | 277/606 |
| 5,377,361 | A * | 1/1995 | Piskula | 4/252.4 |
| 5,501,075 | A * | 3/1996 | Spies et al. | 60/605.1 |
| 5,639,099 | A * | 6/1997 | Booker et al. | 277/402 |
| 5,833,243 | A * | 11/1998 | Booker et al. | 277/606 |
| 5,941,535 | A * | 8/1999 | Richard | 277/606 |
| 6,033,063 | A | 3/2000 | Tomikawa et al. | |

(Continued)

FOREIGN PATENT DOCUMENTS

| | | | |
|---|---|---|---|
| CN | 2210287 | Y | 10/1995 |
| CN | 1467122 | A | 1/2004 |

(Continued)

OTHER PUBLICATIONS

Written Opinion of the International Searching Authority for PCT/US2008/064236 dated Jul. 29, 2008.

(Continued)

*Primary Examiner* — Kristina Fulton
*Assistant Examiner* — Eugene G Byrd
(74) *Attorney, Agent, or Firm* — Hewlett-Packard Patent Department

(57) ABSTRACT

In one embodiment, a seal includes a body of resilient material having a generally cylindrical opening therein. A first, smaller diameter part of the opening is defined by a cylindrical inner surface having a plurality of bumps protruding therefrom, and a second, larger diameter part of the opening is defined by an inwardly bulging sidewall. In another embodiment, an assembly includes: a boss protruding from a boss base; an elastomeric seal comprising a collar and a flexible collar base supporting the collar on the boss base, the collar having an opening therein closely receiving the boss and the collar base configured to flex when compressed along the longitudinal axis and rebound back toward an original position when uncompressed; and a plurality of elastomeric bumps on the collar and/or on the boss, the bumps protruding into the opening such that the collar is supported laterally around the boss on the bumps.

20 Claims, 8 Drawing Sheets

(56) References Cited

U.S. PATENT DOCUMENTS

| | | | | |
|---|---|---|---|---|
| 6,082,741 | A * | 7/2000 | Gregoire et al. | 277/612 |
| 6,457,725 | B1 * | 10/2002 | Jones | 277/606 |
| 6,644,670 | B2 * | 11/2003 | Etcheverry | 277/606 |
| 7,563,050 | B2 * | 7/2009 | Strait | 403/365 |
| 7,584,970 | B2 * | 9/2009 | Ponce | 277/606 |
| 2004/0000763 | A1 | 1/2004 | Gernand et al. | |
| 2006/0012133 | A1 | 1/2006 | Strait | |
| 2006/0079337 | A1 | 4/2006 | Ohshita et al. | |
| 2009/0115140 | A1 * | 5/2009 | Henry | 277/612 |
| 2010/0044972 | A1 * | 2/2010 | Vila | 277/612 |
| 2010/0109259 | A1 * | 5/2010 | Cayzac | 277/606 |
| 2010/0320699 | A1 * | 12/2010 | Takeda et al. | 277/612 |

FOREIGN PATENT DOCUMENTS

| | | |
|---|---|---|
| JP | 2001-058670 | 3/2001 |
| JP | 2004338191 | 12/2004 |
| JP | 2005299686 | 10/2005 |
| JP | 2007-015272 | 1/2007 |
| JP | 2007076218 | 3/2007 |
| WO | 2008029247 A | 3/2008 |

OTHER PUBLICATIONS

European Search Reporting Letter for European Application 08755965.4 dated Jan. 4, 2012.

* cited by examiner

SEAL AND SEAL/BOSS ASSEMBLY

CROSS-REFERENCE TO RELATED PATENT APPLICATIONS

The present application is a continuation of co-pending PCT/US2008/064236 filed on May 20, 2008 by Mark A. Smith and entitled SEAL AND SEAL/BOSS ASSEMBLY, the full disclosure of which is hereby incorporated by reference

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer, or the printhead(s) may remain stationary during printing operations, as in a page width array of printheads. A printhead may be an integral part of an ink cartridge or part of a discrete assembly to which ink is supplied from a separate, often detachable ink container. For printhead assemblies that utilize detachable ink containers, it is important that the operative fluid connection between the outlet of the ink container and the inlet to the printhead assembly, commonly referred to as a fluid interconnection or "F.I.", provide reliable ink flow from the container to the printhead assembly. Typically, ink is drawn from the ink container through a filter on the inlet to the printhead assembly. The inlet to the printhead assembly is commonly referred to as an inlet "tower" because it usually extends out from the surrounding structure. Excessive water vapor leaking from the ink container or printhead assembly at the F.I. could compromise critical properties of the ink. Thus, it is desirable to seal the FI against exposure to the atmosphere even after repeated installations and removals of the ink containers.

A rubber seal fitted around the outside of the tower, for example, may be used to help seal the FI. When an ink container is installed in the printhead assembly, the latching force used to secure the container in place in the printhead assembly presses the container outlet into the seal and compresses the seal against the base of the tower. When the container is removed, the seal rebounds back along the tower toward the original, uncompressed position. Thus, the rubber seal should fit closely to the tower but still be able to move up and down on the tower within a reasonable range of compression and rebound forces that may be generated in the seal with the container latching force. A rubber seal that moves up and down on a molded plastic boss, such as the F.I. tower structure, may employ a cylindrical inside surface mated with a cylindrical outside surface of the boss. The range of the normal force between the inside surface of the seal and the outside surface of the tower may vary by a factor of three depending on the dimensional variation of the parts within the manufacturing tolerance. This range of normal force and the resulting friction force, however, may impede the free movement of the seal on the tower, reducing the ability of the seal to rebound and reseal.

DRAWINGS

DESCRIPTION

Embodiments of the disclosure were developed in an effort, generally, to design a low cost elastomeric seal that fits closely on a molded plastic boss while still allowing sufficiently free movement along the boss throughout the dimensional variation of the parts for a given manufacturing tolerance and, more specifically, to help reliably seal the fluid interconnection between a printhead assembly and a replaceable ink container in an inkjet printer. Embodiments will be described, therefore, with reference to an inkjet printhead assembly that holds detachable/replaceable ink containers. Embodiments of the new seal and other aspects of the disclosure, however, are not limited to such implementations. The example embodiments shown in the Figures and described below, therefore, illustrate but do not limit the scope of the disclosure.

Figure 1:
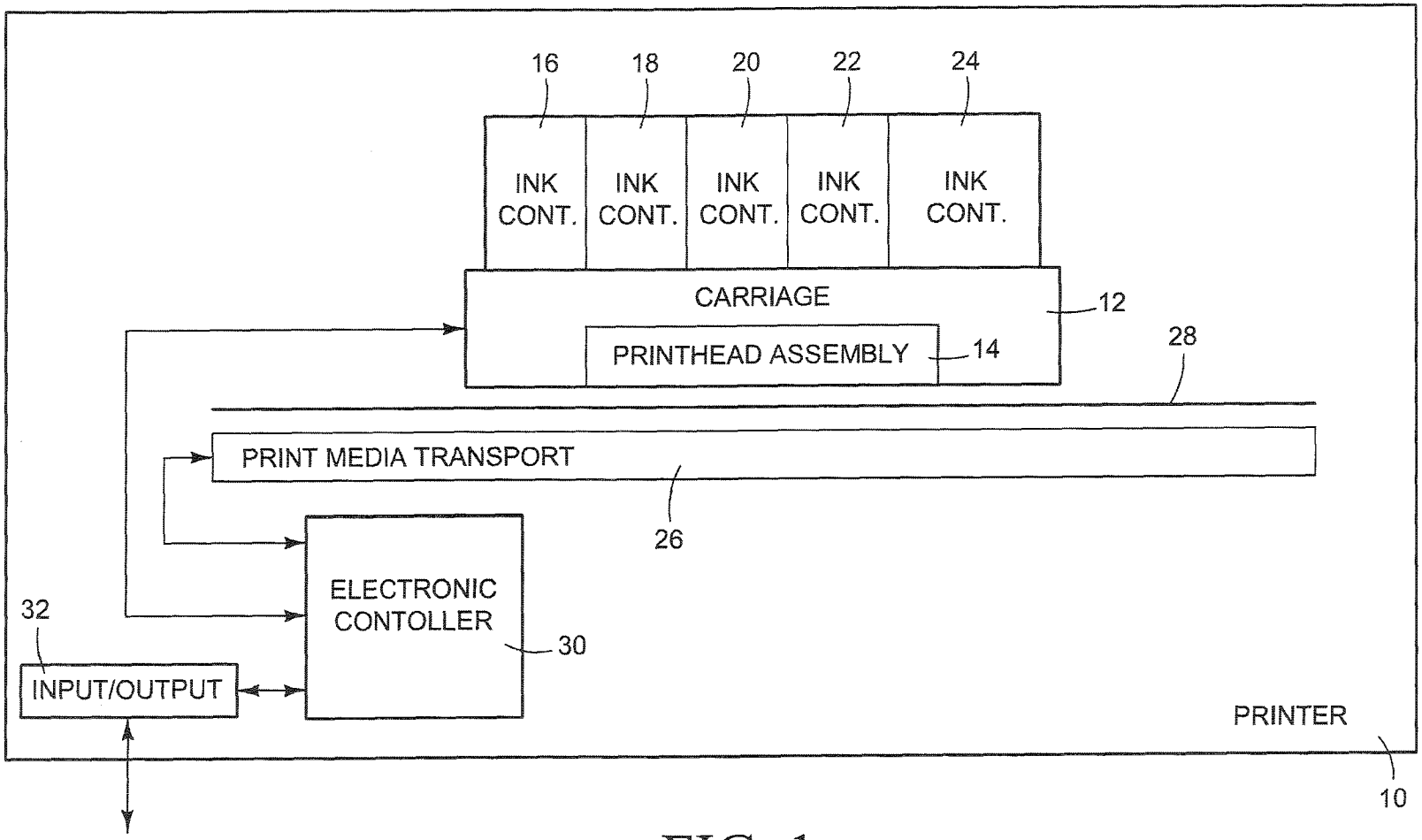
FIG. 1 is a block diagram illustrating one embodiment of an inkjet printer.

FIG. 1 is a block diagram illustrating an inkjet printer 10 in which embodiments of the new seal may be implemented. Referring to FIG. 1, printer 10 includes a carriage 12 carrying a printhead assembly 14 and detachable, replaceable ink containers 16, 18, 20, 22, and 24. Inkjet printer 10 and printhead assembly 14 represent more generally a fluid-jet precision dispensing device and fluid ejector assembly for precisely dispensing a fluid, such as ink. Printhead assembly 14 includes a printhead (not shown) through which ink from one or more containers 16-24 is ejected. For example, printhead assembly 14 may include two printheads—one for a series of smaller, color containers 16-22 and one for a larger, black ink container 24. An inkjet printhead is typically a small electromechanical assembly that contains an array of miniature thermal, piezoelectric or other devices that are energized or activated to eject small droplets of ink out of an associated array of orifices. A typical thermal inkjet printhead, for example, includes an orifice plate arrayed with ink ejection orifices and firing resistors formed on an integrated circuit chip.

A print media transport mechanism 26 advances print media 28 past carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath. An electronic controller 30 is operatively connected to a moveable, scanning carriage 12, printhead assembly 14 and media transport 26. Controller 30 communicates with external devices through an input/output device 32, including receiving print data for inkjet imaging. The presence of an input/output device 32, however, does not preclude the operation of printer 10 as a stand alone unit. Controller 30 controls the movement of carriage 12 and media transport 26. Controller 30 is electrically connected to each printhead in printhead assembly 14 to selectively energize the firing resistors, for example, to eject ink drops on to media 28. By coordinating the relative position of carriage 12 with media 28 and the ejection of ink drops, controller 30 produces the desired image on media 28.

While an inkjet printing device for ejecting ink onto print media is shown and described as one example implementation for embodiments of the new seal, such devices are not limited to jetting ink. In general, embodiments of the present disclosure described with reference to an inkjet printer or inkjet printing components pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, embodiments described with reference to an inkjet printer and a printhead assembly for ejecting ink onto media pertain more generally to any type of fluid-jet precision dispensing device or fluid ejector structure for dispensing a substantially liquid fluid.

Figure 2:
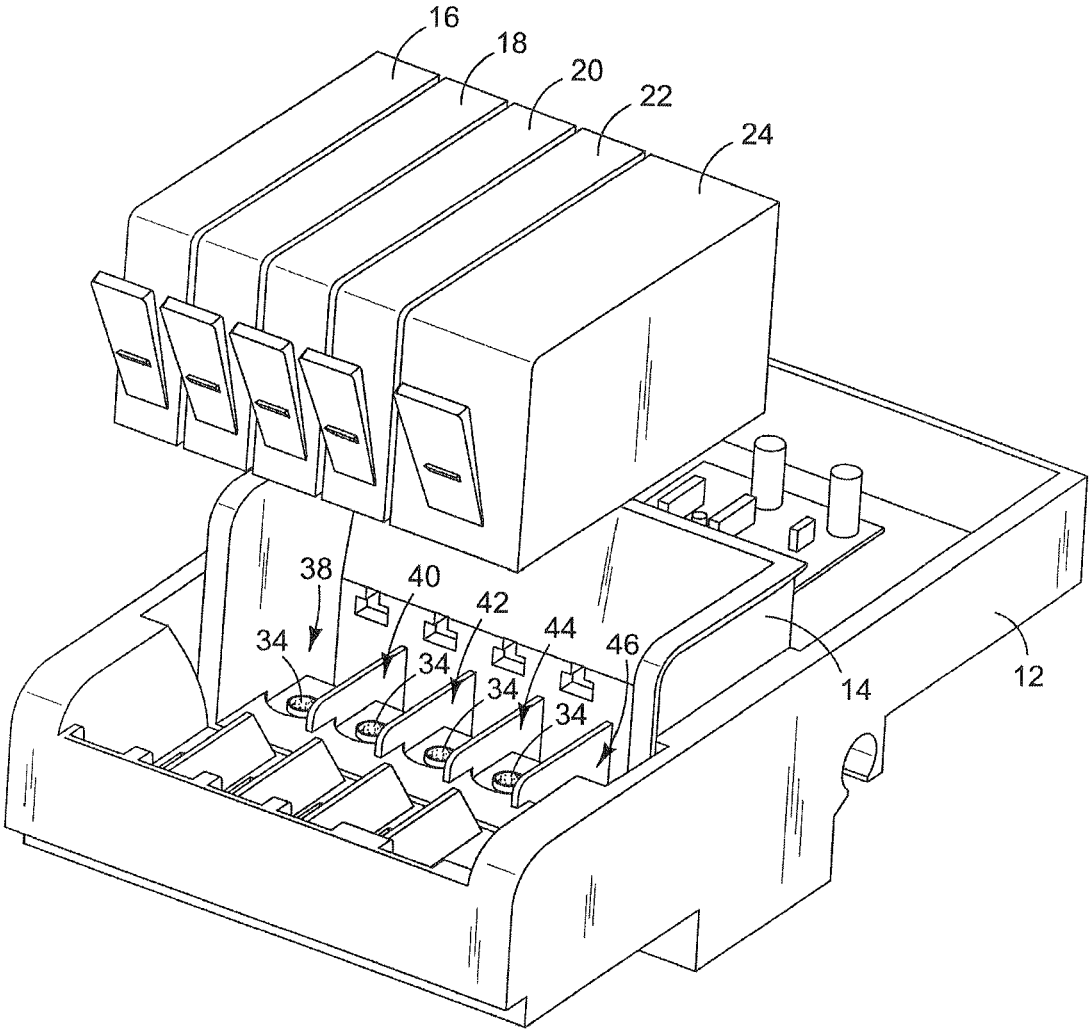
FIGS. 2 and 3 are perspective views of one embodiment of a carriage and printhead assembly, such as might be used in the printer of FIG. 1, with the ink containers exploded out from the carriage to show the inlets to the printhead assembly (FIG. 2) and the outlets from the ink containers (FIG. 3).
Figure 3:
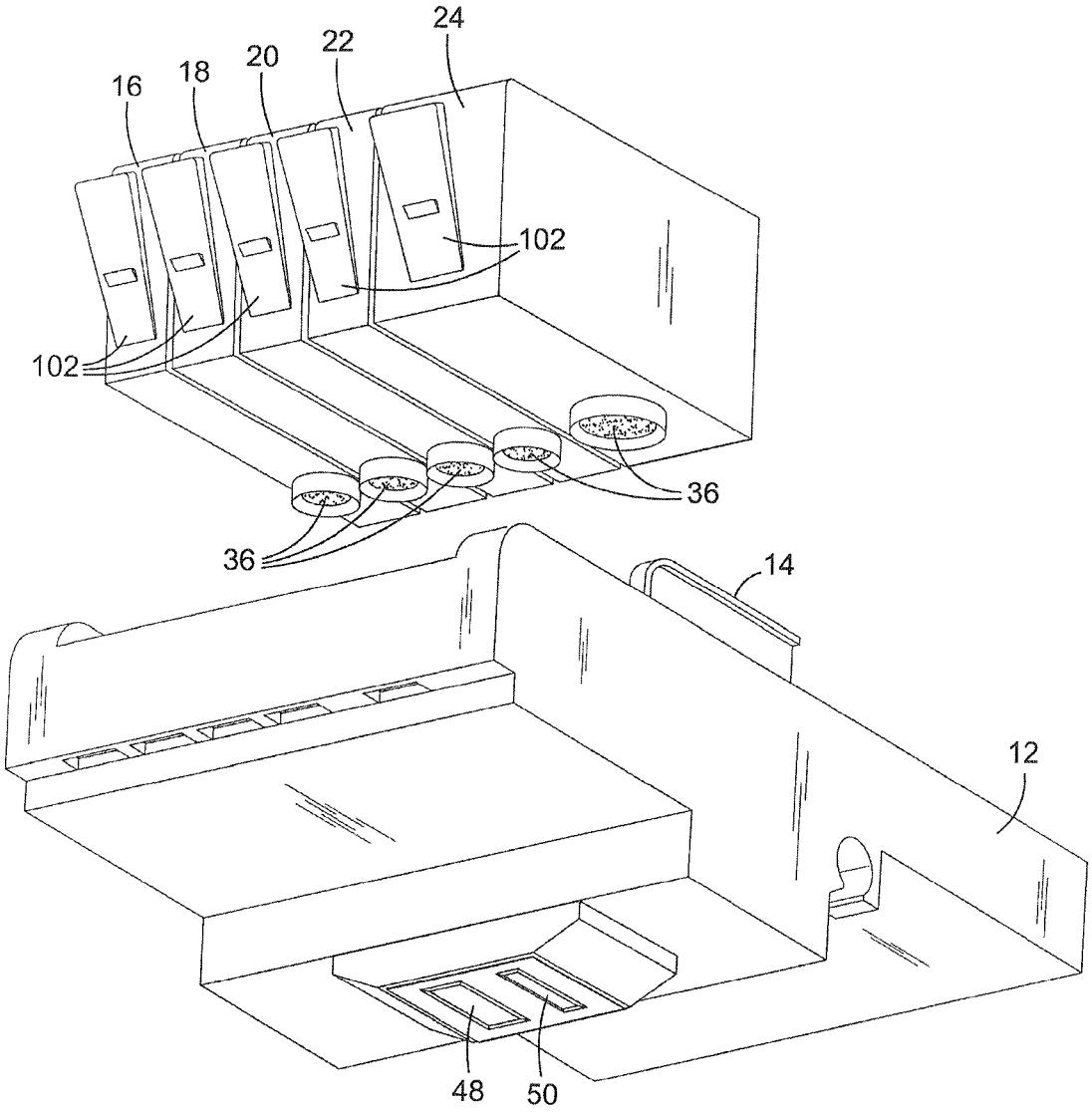
Figure 4:
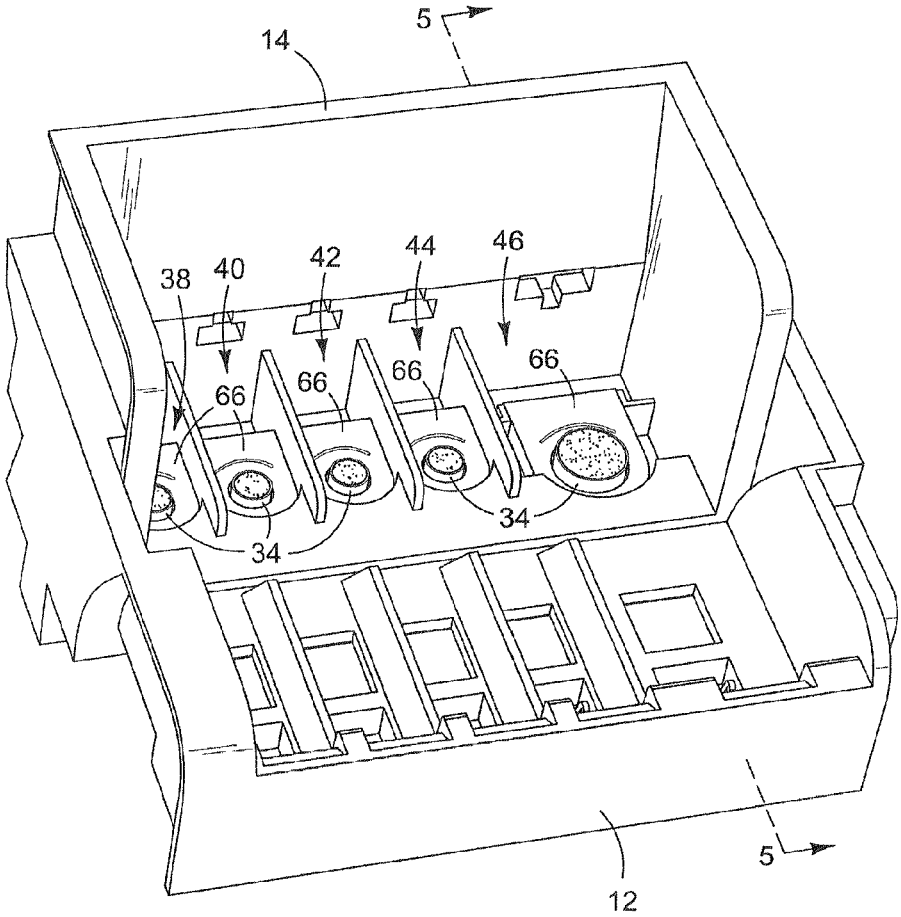
FIG. 4 is close-up perspective view of a portion of the carriage and printhead assembly of FIGS. 2 and 3 showing the ink inlets in more detail.

FIGS. 2 and 3 are perspective views of one embodiment of a carriage 12 and printhead assembly 14 in printer 10. Ink containers 16-24 are exploded out from carriage 12 to show ink inlets 34 to printhead assembly 14 in FIG. 2 and to show ink outlets 36 from ink containers 16-24 in FIG. 3. FIG. 4 is a close-up perspective view of a portion of the carriage 12 and printhead assembly 14 showing ink inlets 34 in more detail. Referring first to FIGS. 2 and 4, printhead assembly 14 includes an ink inlet 34 positioned at each bay 38, 40, 42, 44, and 46 for a corresponding ink container 16-24. Printhead assembly 14 and carriage 12 may be integrated together as a single part or printhead assembly 14 may be detachable from carriage 12. For a detachable printhead assembly 14, container bays 38-46 may extend out into carriage 12 as necessary or desirable to properly receive and hold containers 16-24. Referring now also to FIG. 3, in the embodiment shown, printhead assembly 14 includes two printheads 48 and 50. Ink from color ink containers 16-22, for example, is ejected from printhead 48 and ink from a black ink container 24 is ejected from printhead 50. Each ink container 16-24 includes an ink outlet 36 through which ink may flow from container 16-24 through an inlet 34 to a corresponding printhead 48 or 50 in printhead assembly 14.

Figure 6:
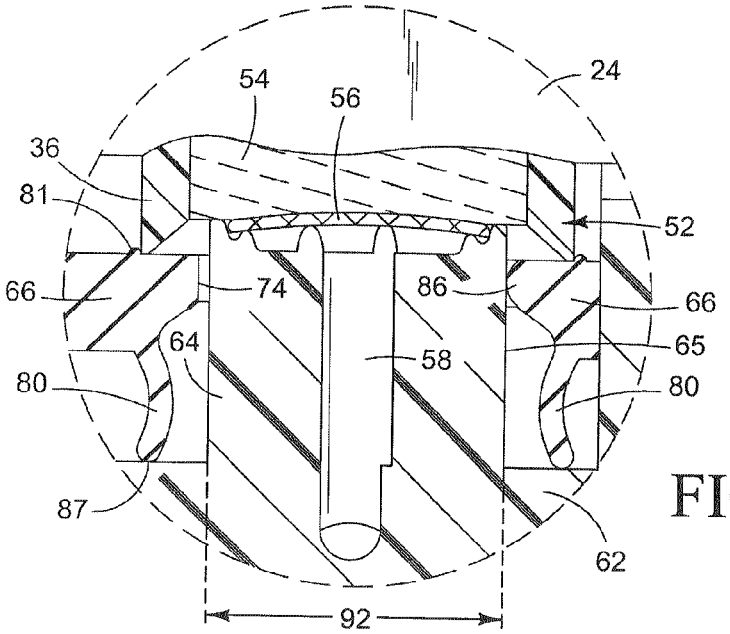
FIG. 6 is close-up section view showing the fluid interconnection of FIG. 5 in more detail.
Figure 5:
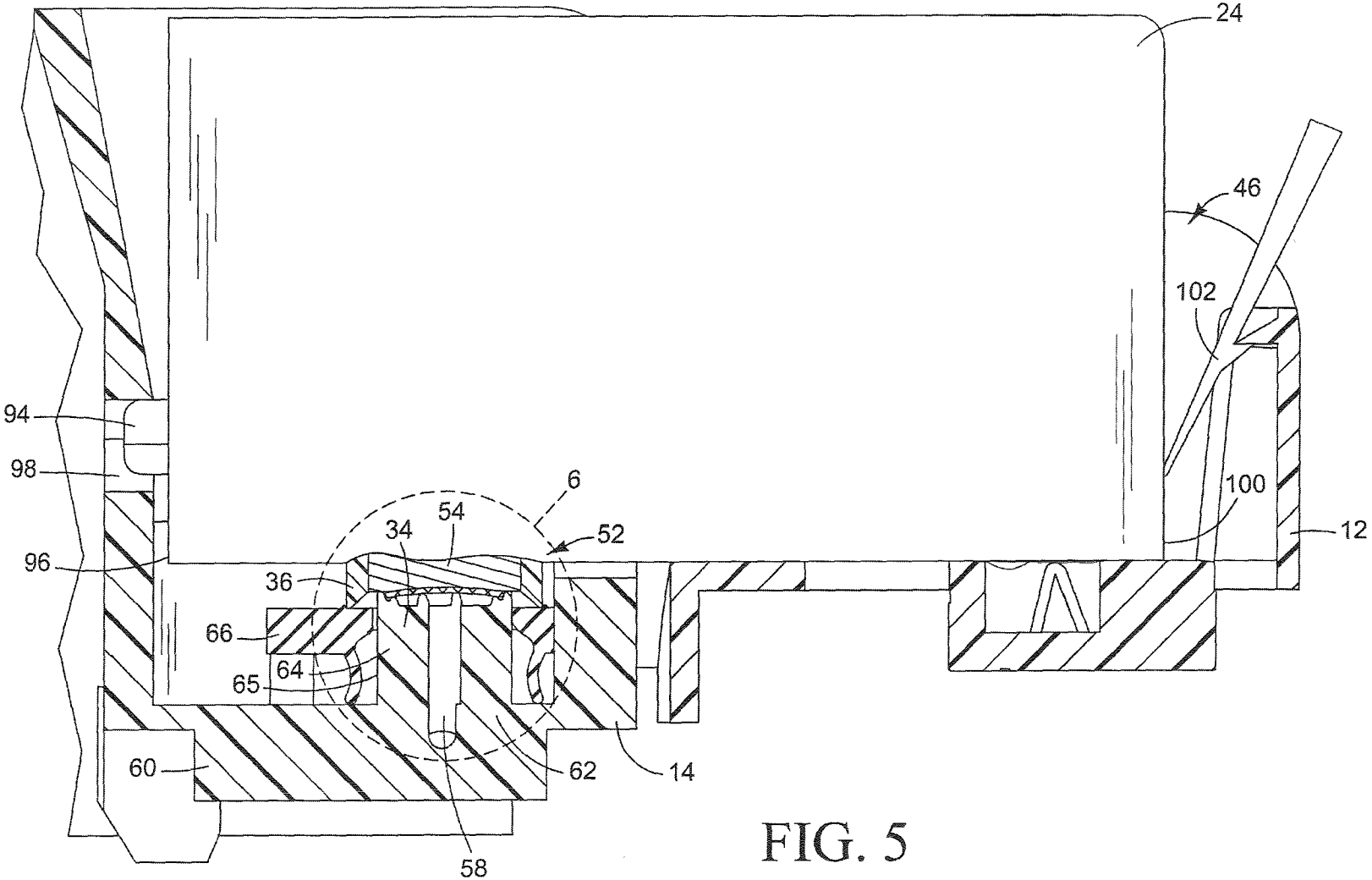
FIG. 5 is a section view taken along the line 5-5 in FIG. 4 showing one embodiment of a seal for sealing the fluid interconnection between the container outlet and the printhead assembly inlet.

FIG. 5 is an elevation section view showing one embodiment of a fluid interconnection 52 between an ink container 24 and printhead assembly 14. FIG. 6 is close-up section view showing fluid interconnection 52 in more detail. Referring to FIGS. 4-6, fluid interconnection 52 includes a wick 54 in container outlet 36 and a filter 56 at printhead assembly inlet 34. An ink channel 58 downstream from filter 56 carries ink to printhead 50 (FIG. 3). The body 60 of printhead assembly 14 is usually formed as a molded plastic part that includes ink inlet 34. Inlet 34 includes a base 62, a boss 64 projecting up from base 62 and an outer surface 64 of boss 64. Inlet boss 64 is sometimes referred to as a "tower" because it extends out from the surrounding base structure. Container outlet 36 fits around inlet tower 64 and seals against an elastomeric or other suitably resilient seal 66 to help prevent water vapor from leaving fluid interconnection 52.

Figure 7:
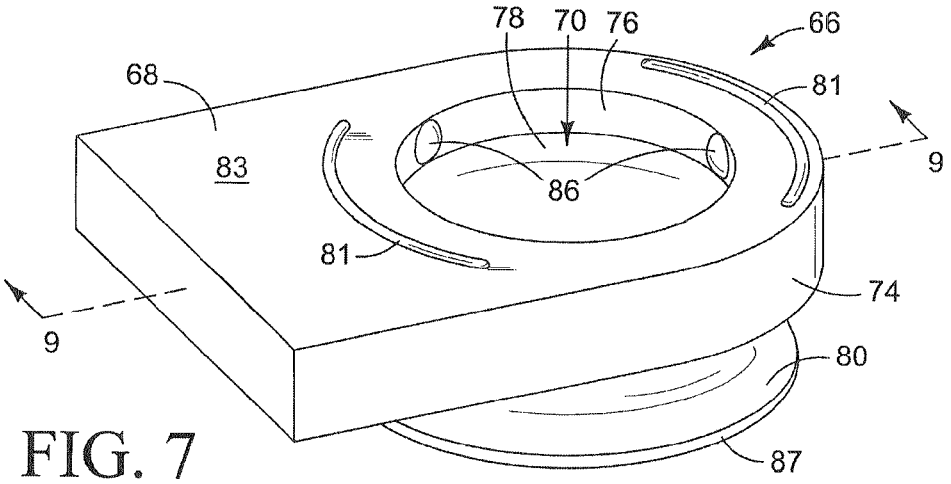
FIGS. 7-9 are perspective, plan and section views, respectively, of the seal shown in FIG. 5.
Figure 8:
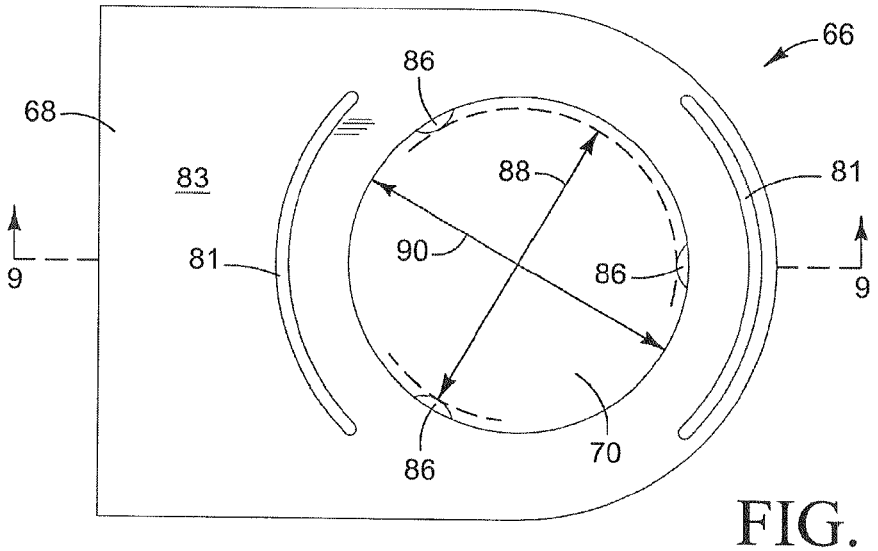
Figure 9:
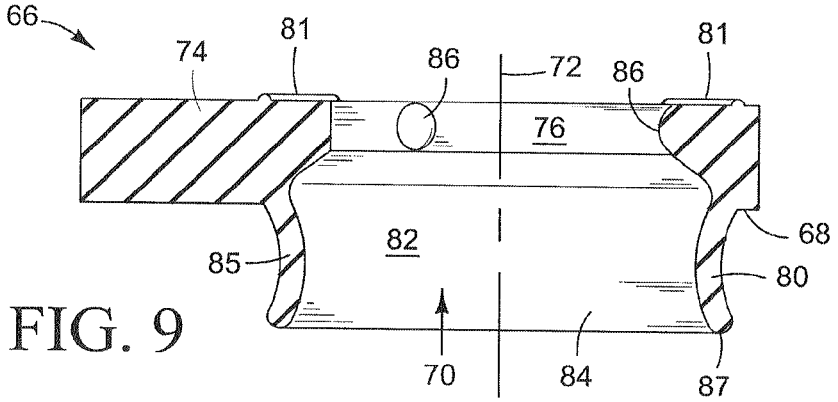

Seal 66 is shown in more detail in FIGS. 7-9. Referring to FIGS. 6-9, seal 66 may be characterized as having a body 68 made of an elastomeric or other suitable resilient material. Body 68 defines a generally cylindrical opening 70 that extends along a longitudinal axis 72. A collar part 74 of body 68 forms a cylindrical inner surface 76 that defines a first, smaller diameter part 78 of opening 70. An inwardly bulging base part 80 of body 68 forms a curved inner surface 82 that defines a second, larger diameter part 84 of opening 70. A plurality of bumps 86 protrude from collar inner surface 76. In the embodiment shown, bumps 86 are spherical caps spaced evenly around the circumference of inner surface 76. Other suitable configurations may be possible. In an alternative configuration, bumps 86 may be configured as ridges extending along the length (along axis 72) of collar surface 76, for example, to distribute the normal forces along a greater distance, and increasing the friction between the two surfaces 65 and 74. In alternative configurations, the bumps for be formed on tower outside surface 65, as described below with reference to FIGS. 14 and 15, or on both collar surface 76 and tower surface 65.

A pair of arcuate ridges 81 may be formed in the comparatively expansive top surface 83 of seal 66 to help prevent these large areas on two tacky seals from sticking together during bulk packaging and/or feeding operations When seal 66 is in place in printhead assembly 14, as shown in FIGS. 5 and 6, collar 74 fits onto inlet tower 64 supported on base 80. A bottom rim 87 of base 80 rests on inlet base 62. Smaller opening part 78 may be characterized as having two inside diameters—an inner inside diameter, represented by part number 88 in FIG. 8, and an outer inside diameter, represented by part number 90 in FIG. 8. Inner inside diameter 88 is defined by a circle passing through a tangent to the inside point of each bump 86. Outer inside diameter 90 is defined by the diameter across inner surface 76.

In one example configuration, inner I.D. 88 is smaller than the nominal outside diameter 92 (FIG. 6) of inlet tower 64 by an amount about equal to the manufacturing tolerance (t) for the two parts (inner I.D. 90≈tower O.D. 92−t) and outer I.D. 90 is equal to or slightly larger than the nominal tower O.D. 92 plus the tolerance of the two parts (outer I.D. 90≥tower O.D.+t). Accordingly, the height of each bump 86 is equal or slightly greater than the tolerance of the two parts, by the same amount that outer I.D. 90 is greater than the tolerance, if any ($h_{bump}$≥t). In this configuration, if the dimensional variation in the two parts is smaller by the full amount of the tolerance (i.e., the greatest gap between outer I.D. 90 and tower O.D. 92), inner I.D. 88 will be about equal to tower O.D. 92, maintaining an engaged fit between the parts. If, however, the dimensional variation in the two parts is larger by the full amount of the tolerance (i.e., the smallest gap between outer I.D. 90 and tower O.D. 92), then bumps 86 will be compressed and/or collar inner surface 76 deformed into a trilobular shape but tower O.D. 92 will not contact collar outer I.D. 90. Thus, seal collar 74 is in contact with inlet tower outer surface 65 only at bumps 86 through the full range of the manufacturing tolerance between seal 66 and tower 64.

Referring again to FIG. 5, ink container 24 is installed in bay 46 with a toe-to-heel motion in which a key 94 on the front/toe 96 of container 24 is inserted into a mating keyway 98 in printhead assembly 14, and then the rear/heel 100 of container 24 is rotated down into bay 46 until a spring latch lever 102 snaps into carriage 12. The latching force generated through this installation sequence presses and holds container outlet 36 against seal 66, compressing seal 66 as described below with reference to FIGS. 10-11 and 12-13.

Figure 10:
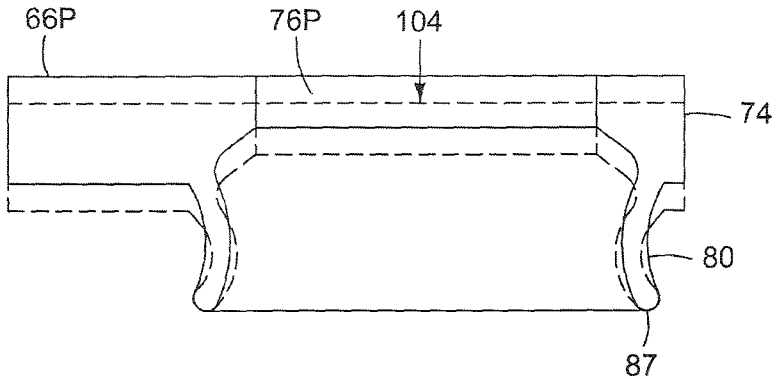
Figure 11:
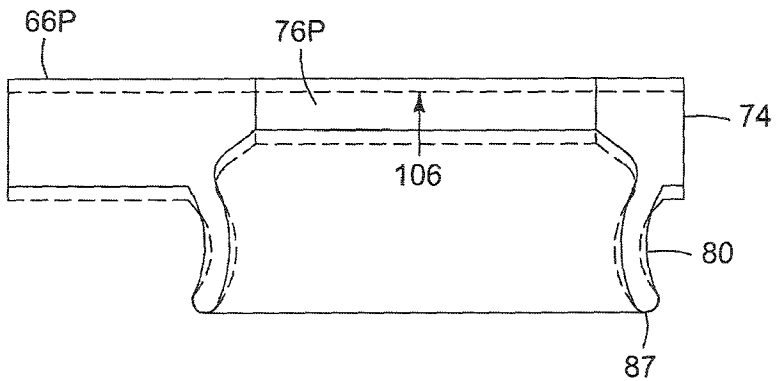

FIGS. 10-11 and 12-13 are section views illustrating the improved ability of a bumpy collar configuration (FIGS. 12-13), such as that shown in FIGS. 6-9, to rebound after compression compared to a plain collar configuration (FIGS. 10-11). Cross hatching and contour lines are omitted from FIGS. 10-13 for clarity. FIGS. 10-13 illustrate generally the results of computer modeling showing much lower normal forces between the seal and the inlet tower for the three bump configuration shown in FIGS. 7-9 compared to a plain configuration (for a nearly incompressible elastomeric seal using the same coefficient of friction and the same design tolerances (±) indicating the degree of interference fit from a greater interference fit at "−" to virtually no interference fit at "+").

Figure 12:
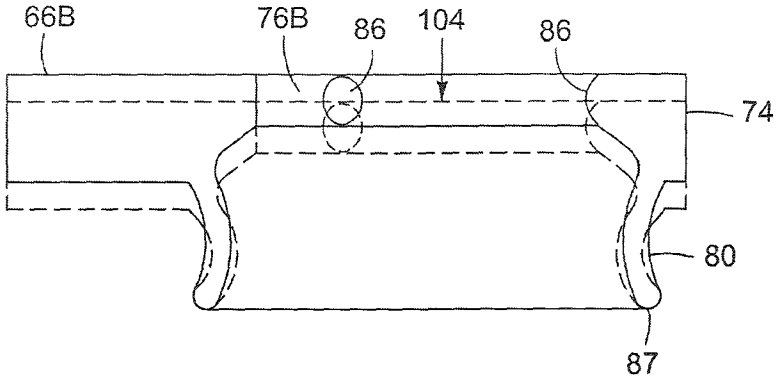
FIGS. 10-11 and 12-13 are section views illustrating the improved ability of a bumpy surface seal design (FIGS. 12-13), such as that shown in FIGS. 6-9, to rebound after compression compared to a plain surface seal design (FIGS. 10-11).

FIG. 10 illustrates the compression of a seal 66P having a plain collar inner surface 76P when an ink container 16-24 is latched into position in a bay 38-46, as noted above with respect to FIG. 5. FIG. 12 illustrates the compression of a seal 66B having a bumpy a collar inner surface 76B. In the plain collar surface configuration, the contact area between seal collar 74 and inlet tower outer surface 65 extends all around the two surfaces. In the bump collar surface configuration, by contrast, the contact area between seal collar 74 and tower outer surface 65 is confined to the three bumps 86. Direction arrows 104 in FIGS. 10 and 12 show the compression of seals 66P and 66B (when a container is latched into place) from an original uncompressed position, indicated by solid lines, to a compressed position, indicated by dashed lines. Bulging base 80 flexes as each seal 66P and 66B is compressed, generating a sealing force that pushes base rim 87 into and seals rim 87 against inlet base 62 and a rebound force urging each seal 66P and 66B back toward an uncompressed position.

Figure 13:
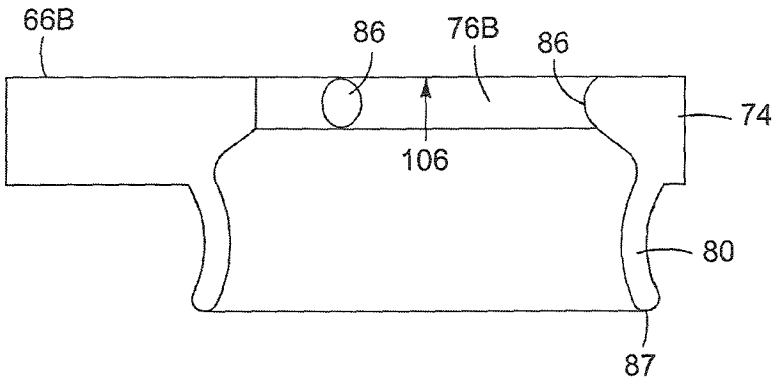

FIG. 11 illustrates the decompression, or rebound, of plain collar seal 66P, when an ink container 16-24 in a bay 38-46 is unlatched for removal and replacement, for example. FIG. 13 illustrates the decompression, or rebound, of bumpy collar seal 66B. Direction arrows 106 in FIGS. 11 and 13 show the rebound of seals 66P and 66B (when a container is unlatched) from the compressed position, indicated by dashed lines, to an uncompressed position, indicated by solid lines. As shown in FIG. 11, the increased contact area between a plain collar inner surface 76P and tower outer surface 65, and the corresponding higher friction force, significantly impedes decompression, preventing seal 66P from rebounding fully to the original uncompressed position. As shown in FIG. 13, the much smaller contact area between a bumpy collar inner surface 76B, and the corresponding lower friction force, does not significantly impede decompression, allowing seal 66B to rebound fully (or nearly fully) to the original uncompressed position. Similarly, the reduced contact area and correspondingly lower friction forces between a bumpy collar inner surface 76B and tower outer surface 65 means more of the compression force exerted by the container is used to flex bulging base 80, increasing the sealing force along base rim 87.

Seal 66 described above employs a lower spring constant and a higher preload to help minimize the impact of dimensional variation with a given manufacturing tolerance while increasing the sealing and rebound forces. Bumps 86 help lower the spring constant in two ways. First, bumps 86 reduce the contact area between the elastomeric seal collar 74 and inlet tower 64, thus lowering the spring rate of the elastomeric seal material. Second, three bumps 86 configured as shown and described allows collar 74 to deform at opening 78 into a tri-lobular shape without inner surface 76 contacting inlet tower 64. The sensitivity of the three bump seal configuration to dimensional variation within a given tolerance is significantly reduced compared to a plain cylindrical configuration. This reduced sensitivity allows seal 66 to fit closely on tower 64 and still move more freely on tower 64, improving the reliability of the seal. Also, bumps 66 can be included in a molded seal for little or no extra cost for a reliable, low cost, single-piece seal.

Figure 14:
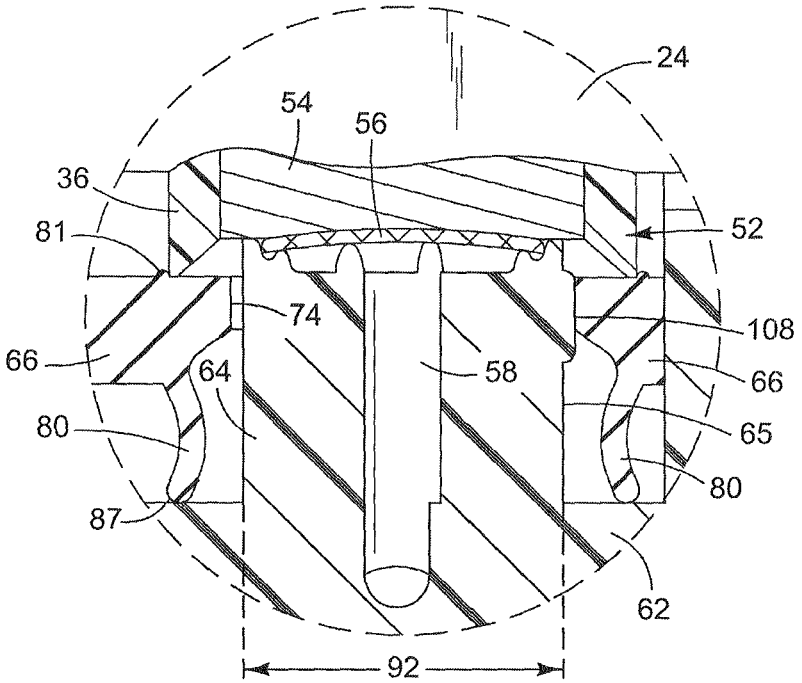
FIG. 14 is close-up section view showing a fluid interconnection according to another embodiment of the disclosure.
Figure 15:
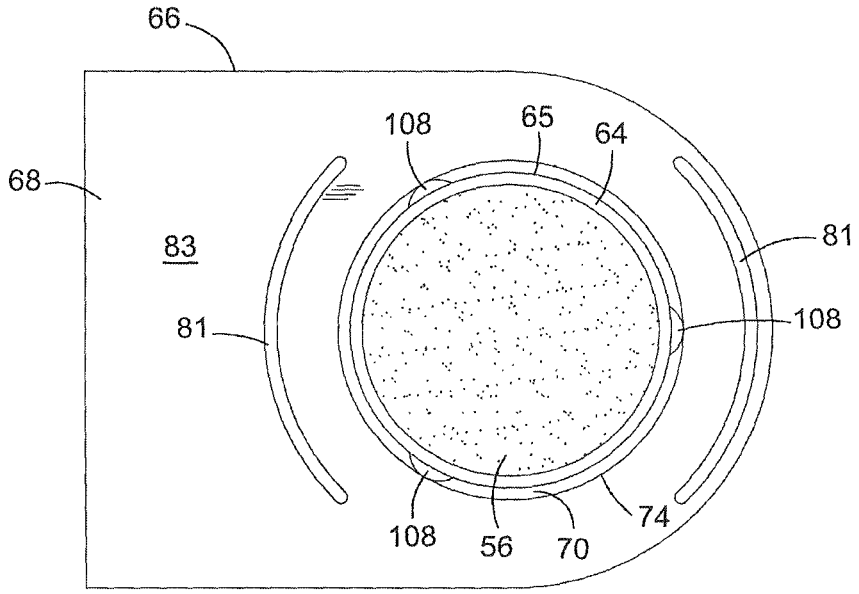
FIG. 15 is a plan view of the printhead assembly inlet tower and seal shown in FIG. 14.

FIGS. 14 and 15 illustrate an alternative embodiment in which the friction control bumps are formed on printhead assembly inlet tower 64, rather than on seal 66. In the embodiment shown in FIGS. 14 and 15, a plurality of ridges 108 protrude from outer surface 65 of inlet tower 64. There are no bumps on inner surface 76 of seal collar 74 (a plain collar seal 66P shown in FIGS. 10 and 11, for example). As shown in FIG. 14, ridges 108 may extend lengthwise along tower surface 65 for a length equal to or greater than the effective length that collar inner surface 76 bears on tower outer surface 65 (the length of collar surface 76 plus the length of compression), to maintain contact along the full length of collar surface 76 throughout seal compression and rebound. Ridges 108 may be longer if necessary or desirable to facilitate molding tower 64.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A seal, comprising a body of resilient material having a generally cylindrical opening therein, a first, smaller diameter part of the opening defined by a cylindrical inner surface having a plurality of bumps protruding therefrom and a second, larger diameter part of the opening defined by an inwardly bulging sidewall.

2. The seal of claim 1, wherein the generally cylindrical opening extends along a longitudinal axis and the inwardly bulging sidewall is configured to flex when the body is compressed along the longitudinal axis to generate a rebound force urging the body back toward an uncompressed position.

3. The seal of claim 1, wherein the bumps comprise three spherical caps spaced evenly about the circumference of the inner surface.

4. The seal of claim 1, wherein the inwardly bulging sidewall includes a curved inner surface defining the second, larger diameter part of the opening.

5. A seal, comprising:

an elastomeric collar having an opening therein for closely receiving a part, the opening having a longitudinal axis;

a plurality of elastomeric bumps on the collar protruding into the opening such that a part received closely into the opening is supported laterally on the bumps, wherein each of the plurality of bumps is spaced from the longitudinal axis by first distance; and a flexible base for supporting the collar, the base configured to flex when compressed along the longitudinal axis and rebound back toward an original position when uncompressed, wherein the base has an inner most surface spaced from the longitudinal axis by second distance greater than the first distance, wherein the collar and base are formed together in a single body of elastomeric material and wherein the flexible base comprises an inwardly bulging sidewall configured to flex when the body is compressed along the longitudinal axis to generate a rebound force urging the body back toward an original uncompressed position.

6. The seal of claim 5, wherein the opening in the collar comprises a cylindrical opening.

7. An assembly, comprising:

a boss protruding from a boss base along a longitudinal axis;

an elastomeric seal comprising a collar and a flexible collar base sandwiched between the collar and the boss base in a direction along the longitudinal axis, the elastomeric seal supporting the collar on the boss base, the collar having an opening therein closely receiving the boss along the longitudinal axis and the collar base configured to flex when compressed against the boss base in the direction along the longitudinal axis and rebound back toward an original position when uncompressed; and a plurality of elastomeric bumps on the collar and/or on the boss, the bumps protruding into the opening such that the collar is supported laterally around the boss on the bumps.

8. The assembly of claim 7, wherein the bumps comprise a plurality of bumps on only the collar.

9. The assembly of claim 8, wherein the opening in the collar comprises a cylindrical opening and the bumps comprise three spherical caps spaced evenly about a periphery of the opening.

10. The assembly of claim 7, wherein the bumps comprise a plurality of bumps on only the boss.

11. The assembly of claim 10, wherein the opening in the collar comprises a cylindrical opening and the bumps comprise three ridges extending lengthwise on and spaced evenly about a periphery of the boss.

12. The assembly of claim 7 further comprising a fluid channel within the boss.

13. The assembly of claim 7, wherein the collar base has radially innermost surfaces radially spaced from and out of contact with the boss.

14. The seal of claim 1, wherein the first smaller diameter part of the opening has a first diameter defined by the cylindrical inner surface, wherein the second larger diameter part of the opening has a second diameter defined by radially innermost surfaces of the inwardly bulging sidewall and wherein the second diameter is larger than the first diameter.

15. The seal of claim 14 further comprising a third part of the opening between the plurality of bumps and the inwardly bulging sidewall, the third part of the opening having a third diameter larger than the first diameter and larger than the second diameter.

16. The seal of claim 1, wherein the body has a first thickness about the first, smaller diameter part of the opening and wherein the inwardly bulging sidewall has a uniform second thickness less than the first thickness.

17. The seal of claim 5, wherein the opening of the elastomeric collar widens between the plurality of elastomeric bumps on the collar and the flexible base.

18. The seal of claim 1, wherein the inwardly bulging sidewall has an inward most surface vertically spaced below the plurality of bumps.

19. The seal of claim 5, wherein the inwardly bulging sidewall has an inward most surface vertically spaced below the plurality of elastomeric bumps.

20. The assembly of claim 7, wherein the collar base comprises an inwardly bulging sidewall having an inward most surface vertically spaced below the plurality of elastomeric bumps.

* * * * *